US005350073A

United States Patent [19]

Thornley, Robert S. et al.

[11] Patent Number: 5,350,073

[45] Date of Patent: Sep. 27, 1994

[54] FREE-STANDING SHELVING SYSTEM

[75] Inventors: Thornley, Robert S., Watford; Christos Papadopoulos, Tickhill, both of England

[73] Assignee: McKechnie (UK) Limited, West Midlands, United Kingdom

[21] Appl. No.: 991,342

[22] Filed: Oct. 19, 1992

[30] Foreign Application Priority Data

Oct. 17, 1991 [GB] United Kingdom ..... 9122088.9

[51] Int. Cl.[5] ..... A47F 5/00

[52] U.S. Cl. ..... 211/187; 108/107

[58] Field of Search ..... 211/187, 186, 192; 248/243; 108/106, 107, 111

[56] References Cited

U.S. PATENT DOCUMENTS

| | | | |
|---|---|---|---|
| 2,886,186 | 5/1959 | Hamilton | 211/186 X |
| 2,990,067 | 6/1961 | Bartlett, et al. . | |
| 3,255,722 | 6/1966 | Ferdinand et al. | 108/107 X |
| 3,294,250 | 12/1966 | Evans, et al. . | |
| 3,367,291 | 2/1968 | Evans | 108/106 X |
| 4,405,052 | 9/1983 | Spiros | 211/187 X |

FOREIGN PATENT DOCUMENTS

| | | |
|---|---|---|
| 172111 | 2/1986 | European Pat. Off. . |
| 685009 | 3/1930 | France . |
| 1441065 | 6/1976 | United Kingdom . |

*Primary Examiner*—Robert W. Gibson, Jr.
*Attorney, Agent, or Firm*—Wenderoth, Lind & Ponack

[57] ABSTRACT

A free-standing shelving system comprises four uprights which support a plurality of rectangular shelves. The shelves are attached at each corner to one of the uprights. Attached at each corner of each shelf is a corner piece equipped with pegs. These pegs engage in corresponding keyhole-shaped holes in the upright to thereby securely clamp the shelf to the upright.

11 Claims, 5 Drawing Sheets

FREE-STANDING SHELVING SYSTEM

BACKGROUND OF THE INVENTION

This invention relates to a free-standing shelving system.

Such shelving systems, which are commonly made from steel, comprise a plurality of uprights and a plurality of shelves which are supported at spaced positions on the uprights. A common basic configuration comprises four uprights supporting three or more rectangular shelves, the uprights being positioned to provide a support at each of the four corners of the shelves. Such a unit is free standing. Several such units can be attached together to form a run of shelving and, in some types, uprights may be shared between adjacent units.

Free standing shelving systems of this general type have been available for many years. Commonly they are supplied as kits which are bolted together to form the shelving. The uprights are equipped with a plurality of spaced holes so that the shelves can be position at any desired height, according to the requirements. The assembly of these shelves, involving as they do many nuts and bolts, is lengthy and awkward and recently attempts have been made to cut down on the assembly time of these systems. One recent system, for example, utilises shelf support clips which are fitted at desired positions on the uprights, and are shaped to support and secure the shelves.

In another system, described in British Patent No. 1441065, the uprights are formed with keyhole-shaped holes, and the shelves are supported on elongate shelf support members which are equipped with pegs which co-operate with the keyholes to provide a frame structure on which the shelves can be laid. The system has the disadvantage of requiring many components to produce even a basic set of shelves and, as such, has little advantage over the conventional nut and bolt system described above.

SUMMARY OF THE INVENTION

In the system of the present invention, however, the number of component parts needed to make a set of shelves is reduced to the minimum because neither bolts, clips, or separate shelf supports, are required. Instead, according to the invention the shelves themselves are provided with protruding attachment means which are co-operatively engageable with holes in said uprights. Such attachment means may for example take the form of a protruding peg with an enlarged head and the holes in the supports may each be shaped in the manner of a keyhole with an enlarged portion, sized to receive said enlarged head, and a relatively narrow portion sized to fit the shank of the peg. A secure attachment can thus be effected for each corner of each shelf by slotting the peg at that corner into the desired hole in the upright and moving the peg into the narrowed portion of the hole. For added rigidity two or more pegs may be provided at each corner of each shelf, each such peg being co-operatively engageable with an adjacent spaced hole on the upright. In order to provide the necessary surface area for such extra pegs, the shelf edges may be extended to provide a flange or similar structure.

By these means, it is possible to fabricate a free-standing shelving system which is both rigid and easy to adapt to changing circumstances. Assembly is very quick, since the only components required to make the basic unit are the uprights and the shelves.

BRIEF DESCRIPTION OF THE DRAWINGS

In order that the invention may be better understood, several embodiments thereof will now be described by way of example only and with reference to the accompanying drawings in which.

DETAILED DESCRIPTION OF THE PREFERRED EMBODIMENTS

Figure 1:
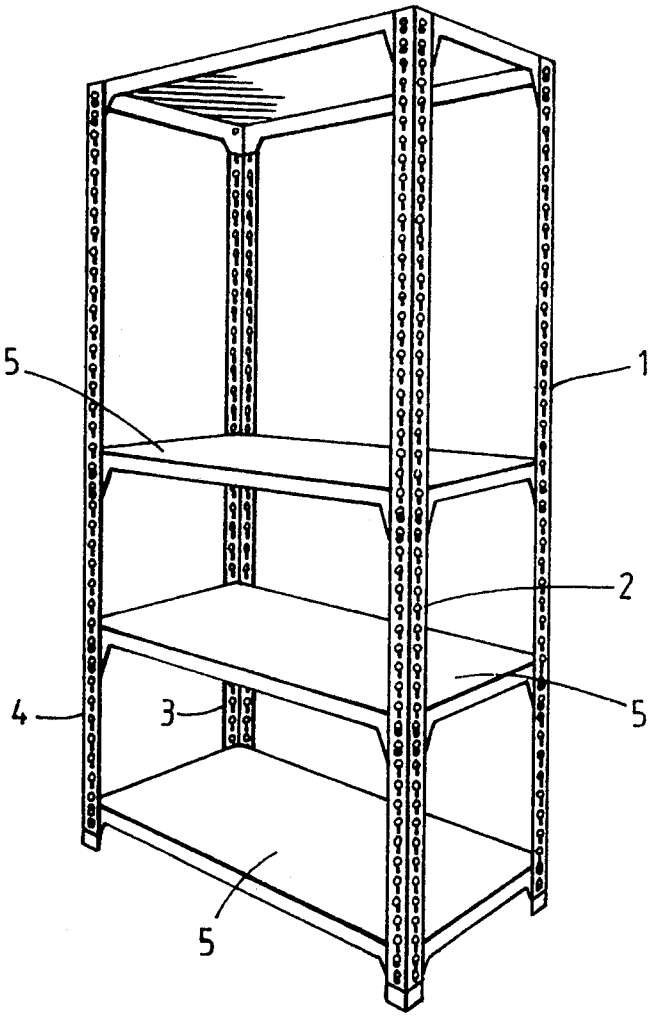
FIG. 1 is a pictorial perspective view showing the general type of shelving unit with which the present invention is concerned.

Referring first to FIG. 1, the shelving system illustrated comprises four uprights 1 to 4 which support a plurality of shelves 5. The uprights are equipped along their length with spaced holes so that the shelves can be fitted at a variety of positions, according to the circumstances of use. The basic shelving unit may be used simply as a basic shelving system, either alone or as part of a larger system, and may be free-standing or attached to an adjacent wall. Various additions may be made to enhance the product such as tool hooks, storage baskets and cupboard doors, side and back panels as illustrated. The bottoms of the uprights may be fitted with caps, as shown, to prevent damage to the floor surface.

Reference is now made to FIGS. 2 to 5 which show in detail a first embodiment of the invention. The invention is directed to the problem of finding a rigid and secure fitting of each shelf 5 to the uprights 1 to 4. To illustrate this, just a single shelf 5 is shown in the following drawings, for clarity.

Figure 5:
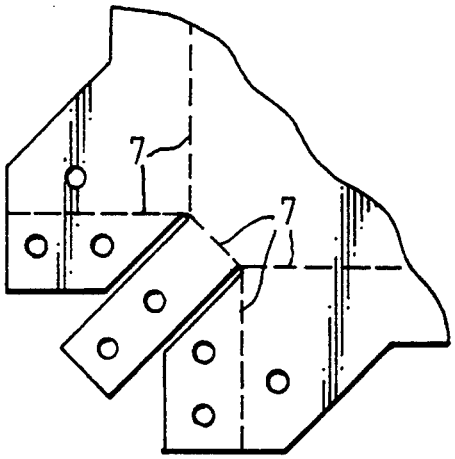
FIG. 5 is a view of part of the shelf forming part of the embodiment of FIG. 2 in a condition before being formed to shape.
Figure 6:
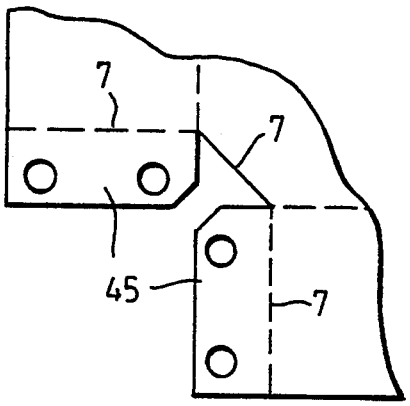
FIG. 6 is a view similar to FIG. 5, showing an alternative construction.

Each shelf comprises sheet material, for example steel, which initially has the corner shape illustrated in FIG. 5 but which, during manufacture, is folded along dotted lines 7 to give a perimeter flange portion 8. The flange 8 serves to improve the load carrying capacity of the shelf whilst at the same time providing a surface on which are provided the interengagement means. For this purpose, the flange portion 8 is enlarged at each corner of the shelf to form mutually orthogonal surfaces 9, 10 at each corner. Joining the surfaces 9, 10, and at 45° to each, is an intermediate surface 29 on which are formed the interengagement means, to be described later. An alternative corner shape is illustrated in FIG. 6, in which the intermediate surface 29 is formed by the overlapping tabs 45.

Figure 2:
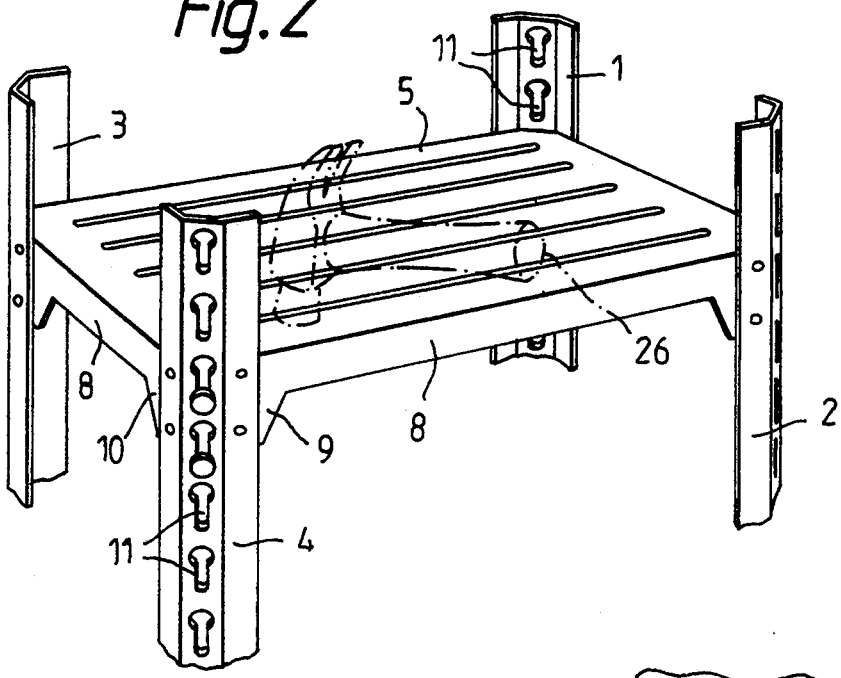
FIG. 2 is a perspective view of part of a shelving system, illustrating a first embodiment of the invention.
Figure 3:
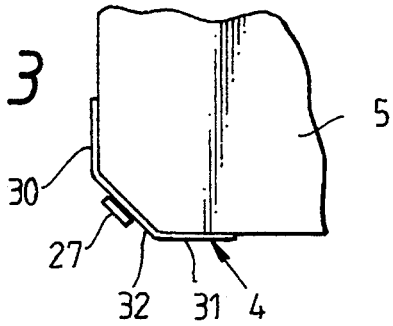
FIG. 3 is a plan view of one corner of the structure shown in FIG. 2.

The uprights 1 to 4, for example, also of steel, are not simple right-angle sections, as previously, but have an open trapezoidal section, clearly illustrated in FIGS. 2 and 3, defining mutually orthogonal sections 30, 31 and intermediate section 32 joining sections 30, 31 and which is at 45° to sections 30, 31. Thus the interior contour of the uprights matches the exterior contour of the shelf corners, as defined by surfaces 9, 10 and 29. The intermediate section 32 of each upright 1 to 4 is formed with a plurality of equally-spaced holes 11 of keyhole-shape.

The interengagement means at each corner of each shelf comprises, on each of the surfaces 29, a respective pair of pegs 27,28. These pegs are intended to engage with respective holes 11 in said uprights. To this end, the pegs of each pair 27/28 are vertically spaced by an amount equal to the pitch of the holes 11 in the uprights.

Each peg 27,28 is formed as a narrow shank portion and an enlarged head portion. Likewise, each hole 11 is formed in the manner of a keyhole, with a narrow portion and an enlarged portion.

Assembly of the shelves proceeds by offering up the shelf corner at the desired position on the upright so that the heads of pegs 27 and 28 enter respective enlarged portions of two adjacent holes 11. A hammer 26 or similar implement can then be used to tap the shelf into its final position, with the peg shanks securely located in the narrow portions of the holes 11.

Figure 7:
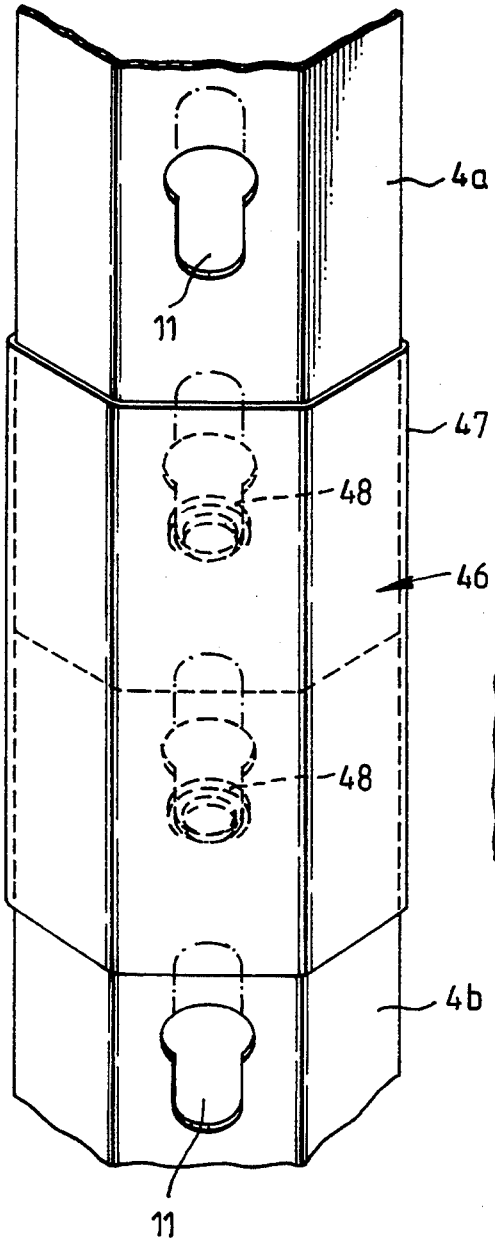
FIGS. 7 and 8 are perspective views showing two alternative ways of joining uprights together to achieve greater height.
Figure 8:
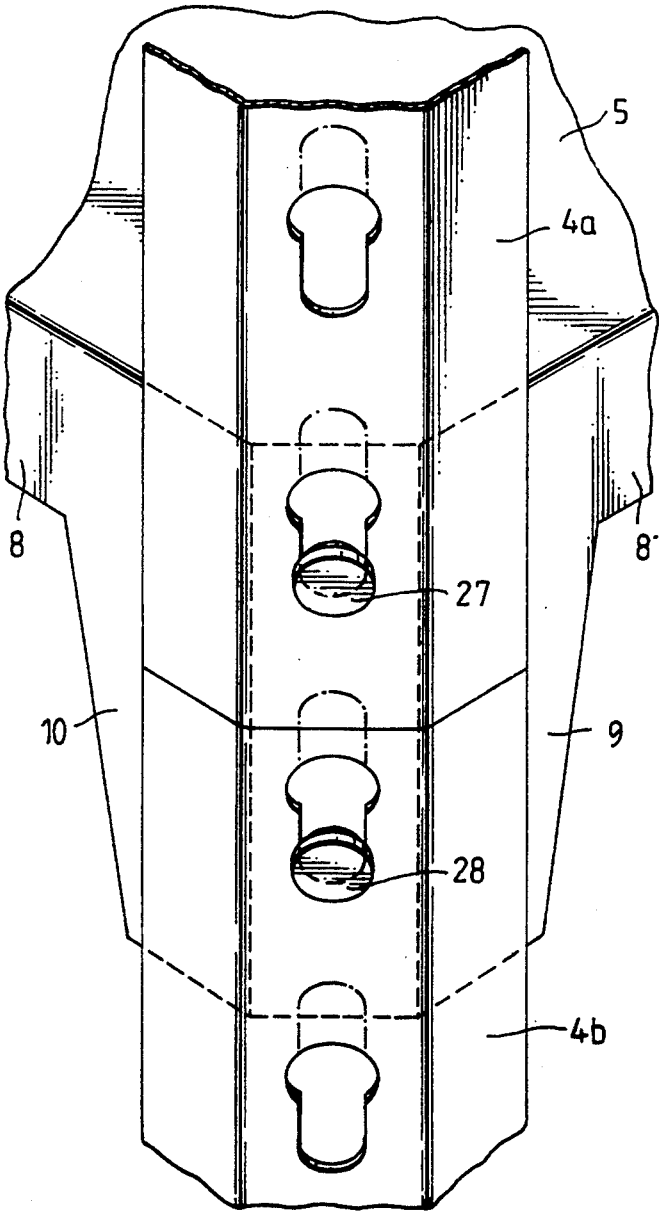

If it is desired to obtain shelving of greater height than just one upright will provide, then uprights may be joined end-to-end, for example in the manner illustrated in one of FIGS. 7 or 8. In FIG. 7, a joiner piece 46 is used to join the uprights 4*a* and 4*b*. The joiner piece is shaped to conform to the exterior contour of the uprights, and has a further fold along edges 47 to enable it to securely clip over the uprights. Inwardly-facing pegs 48, positioned and shaped similarly to pegs 27, 28, are used to secure the uprights. In an alternative construction (not shown), the joiner piece is shaped to conform to the inner contour of the uprights, and is fitted inside the uprights, with the pegs protruding outwardly through the apertures 11.

FIG. 8 shows a similar construction, but in which the existing corner construction of a shelf is used to join uprights 4*a*, 4*b* using pegs 27, 28 together. This has the advantage of not requiring a separate joiner piece, but the disadvantage that there is less flexibility in the positioning of shelves.

FIGS. 7 and 8 incidentally also show an alternative optional shape (dotted) for holes 11, to enable uprights to be used either way up.

Figure 9:
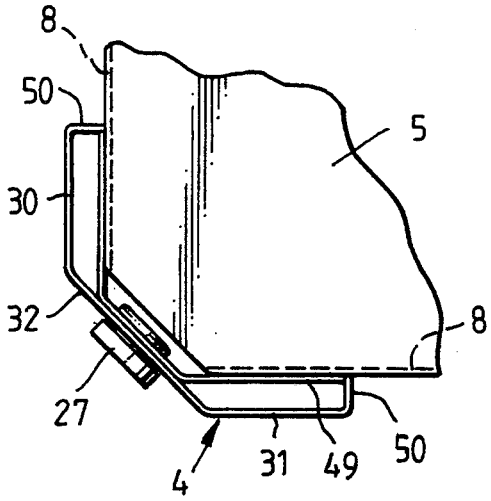
FIGS. 9 and 10 are views corresponding to FIGS. 3 and 4 respectively, illustrating a second embodiment of the invention.
Figure 10:
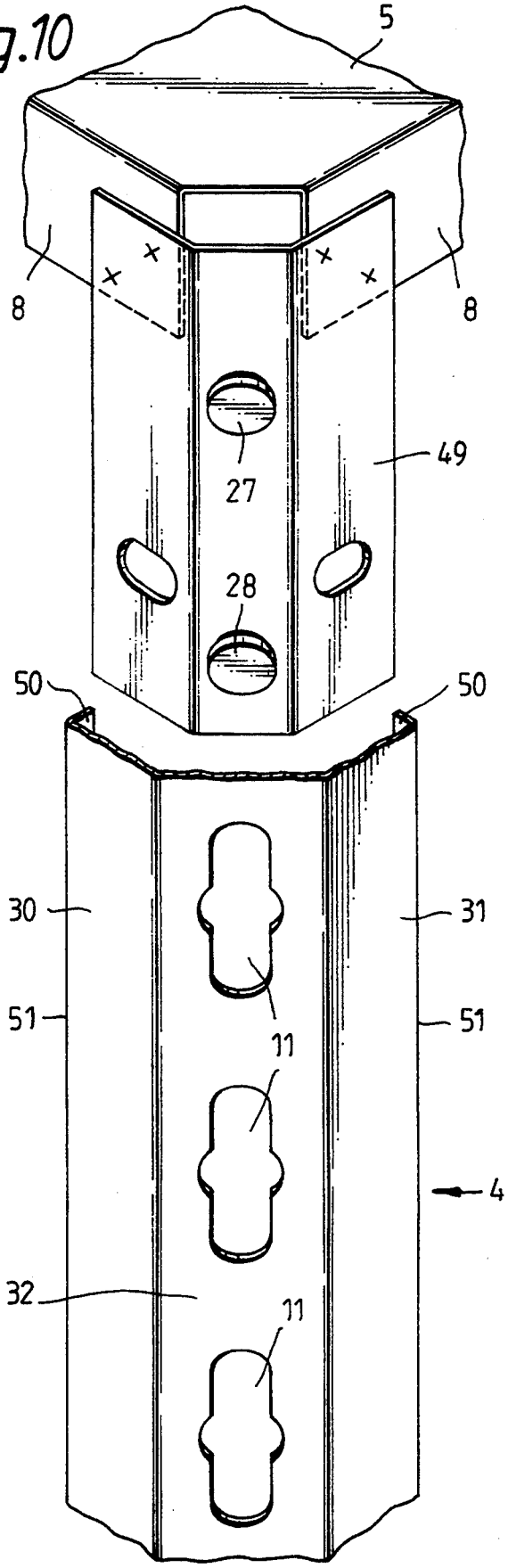

Reference is now made to FIGS. 9 and 10 which show a second embodiment of the invention. This embodiment is very similar to the construction illustrated in FIGS. 2 to 5, except for the shelf corner detail. In this second embodiment, the pegs 27, 28 are mounted on a separate corner piece 49 which has an exterior shape corresponding to the interior shape of the upright 4. The corner piece 49 made, for example, of steel, is fixedly joined to the flanges 8 of shelf 5 by, for example, spot welding (as shown) or gluing or a similar method. For extra rigidity, the corner piece 49 can be made of heavier gauge material than the rest of shelf 5. Surfaces similar to surfaces 9, 10 of FIG. 4 may be formed if desired; however, this uses a lot more material for little added benefit.

Figure 4:
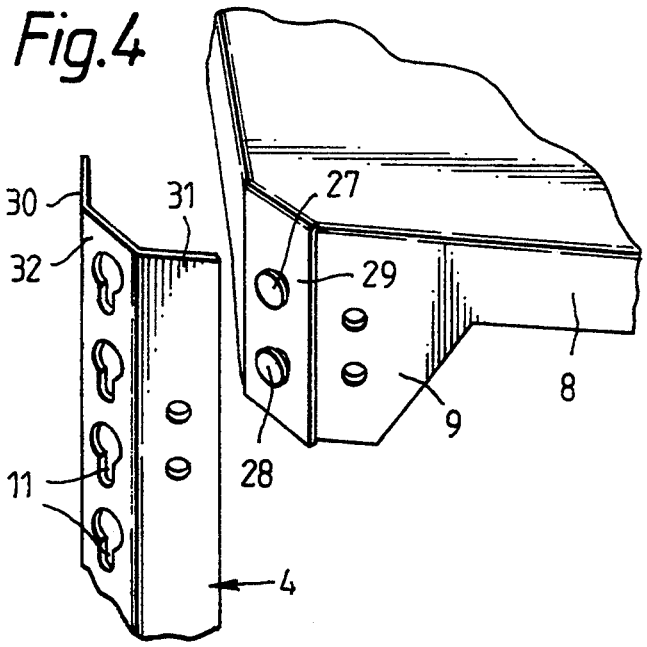
FIG. 4 is an enlarged perspective view showing part of the arrangement of FIG. 2, with parts separated.

The uprights 1 to 4 may be shaped as shown in FIG. 4, but preferably they have an added shallow flange 50 along each of the edges 51. As is clear from FIG. 9, the corner piece 49 is dimensioned so that it snaps into position within the upright, the flanges 50 acting to retain and guide the corner piece as the pegs 27, 28 are lowered in the holes 11 in the manner explained above.

Figure 11:
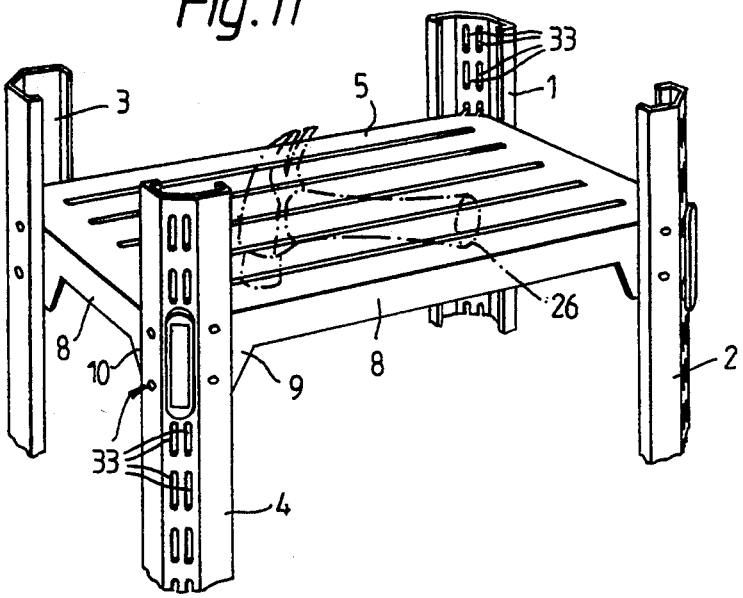
FIGS. 11, 12 and 13 are views corresponding to FIGS. 2, 3 and 4 respectively, illustrating a third embodiment of the invention.
Figure 12:
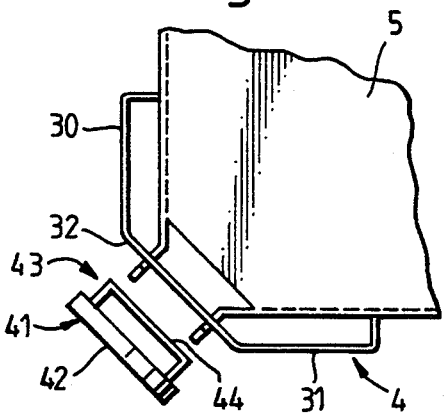
Figure 13:
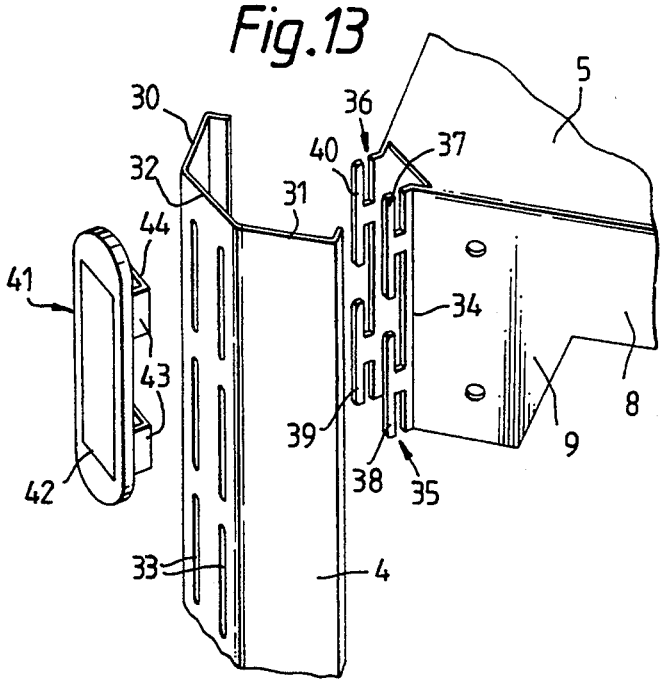

Reference is now made to FIGS. 11 to 13 which show a third embodiment of the invention. This embodiment is similar to that illustrated in FIGS. 2 to 5; however, on the intermediate section 32 of the upright, instead of keyhole-shaped holes 11 are formed pairs of elongate slots 33 which are spaced apart along the length of the upright, as shown. In order to co-operate with these slots, each corner of each shelf 5 is formed in the manner illustrated in FIG. 8. To this end, the sheet material is folded along lines 34 parallel to the uprights to provide a pair of parallel tongues 35, 36 extending outwardly at an angle of 45° to the surfaces 9, 10. The tongues are spaced by a distance equal to the distance between the slots of each pair of slots 33 in the upright.

The tongues 35, 36 are formed to provide four T-shaped tabs 37 to 40 which take the place of the pegs of the first and second embodiments. Each tab 37 to 40 comprises a head portion, and a relatively narrow shank portion. The length of the shank portion is equal to the thickness of the material in section 32 of the upright, plus a tolerance for free fitting. The length of the head of each tab, in the axial direction of the upright, is such as to allow the head of the tab to be freely inserted into the respective slot 33 during assembly. The two tabs on each tongue 35, 36 are spaced apart by an amount equal to the distance between adjacent pairs of slots 33 in the upright.

In order to assemble the shelving unit, the corner of the shelf 5 is offered up to the upright in the manner illustrated in FIG. 13, and the heads of tabs 37 to 40 passed through the slots 33 at the desired height on the upright. The shelf is then tapped downwards as before to securely latch the tabs in the slots 33 such that the head of the tab overlies the outside surface of section 32 of the upright in the manner illustrated in FIG. 12.

Added rigidity may be achieved by attaching a lock button 41 to the exterior surface of section 32. The lock button comprises a front plate 42 which may have a logo or decorative pattern on its exterior surface and which is provided on its back surface with a pair of rectangular open arch structures 43, seen in plan in FIG. 12. Each of the structures 43 includes a member 44, extending parallel to the general plane of the plate 42, which, when the button 41 is fitted, latches behind the protruding heads of the tabs 37 to 40 and wedges itself in the space between the tab heads and the exterior surface of the upright, thus providing a secure attachment.

There have been described several embodiments of shelving systems which can be assembled quickly and easily from a relatively small number of components. The assembled shelving units are strong and rigid and visually more attractive than the conventional shelving systems using nuts and bolts. Appearance can be further enhanced by covering the corners of the uprights, for example with a clip-on strip with a decorative outer surface. Although the drawings show the holes 11 provided along the length of the uprights, this is not of course essential. It may be desirable for aesthetic or cost reasons, or under special circumstances, to place holes 11 only where a shelf is to be put, thus restricting the positioning of shelves 5.

We claim:

1. A free-standing shelving system, comprising:

a plurality of uprights having spaced holes therealong;

a plurality of shelves having exterior surfaces; and an attachment arrangement attaching said shelves to said uprights so that said shelves can extend approximately horizontally between said uprights and be supported thereby, said attachment arrangement comprising a separate corner piece attachment at each corner of each said shelf on the exterior surface thereof such that said corner piece projects outwardly from the exterior surface of said shelf, and each said corner piece extending longitudinally in a direction substantially perpendicular to said shelf and having a protrusion protruding through one of said holes in said uprights;

wherein said uprights have exterior edges with longitudinal flanges thereon, said longitudinal flanges being positioned about said separate corner pieces projecting outwardly from the exterior surfaces of said shelves such that said corner pieces are held substantially rigid with respect to said uprights.

2. The system of claim 1, wherein said exterior surface of each said shelf is on a shelf flange, and said corner pieces are attached to said shelf flanges such that edges of said corner pieces are abutted by said longitudinal flanges of said uprights, said longitudinal flanges further abutting said shelf 3. The system of claim 1, wherein each said corner piece includes an intermediate surface that extends across said corner to which said cover piece is attached.

4. The system of claim 3, wherein said intermediate surface extends across said corner at an angle of approximately 45° with respect to adjacent sides of said shelf having said corner, said intermediate surface having said protrusion thereon.

5. The system of claim 3, wherein each said upright comprises first and second planar sections that extend mutually orthogonally to one another and a third section joining said first and second sections and extending at an angle therebetween such that, when one of said shelves is in position against said upright, said intermediate surface of said corner piece lies substantially parallel to said third section of said upright.

6. The shelving system of one of claims 1 and 3–5, wherein said protrusion on each said corner piece comprises at least one peg protruding outwardly for cooperative engagement with said holes in said uprights.

7. The shelving system of claim 6, wherein each said peg comprises a relatively narrow stem portion and a head portion connected to said stem portion, and each said hole in said uprights comprises an enlarged section sufficiently large for said head portion of said peg to pass therethrough and a smaller section extending from said enlarged section in the longitudinal direction, said smaller section being sufficiently large to receive said stem portion of said peg but too small to allow said head portion of said peg to pass therethrough.

8. The shelving system of claim 6, wherein at least two pegs protrude outwardly from each said corner piece, said pegs being spaced apart in the longitudinal direction a distance equal to the longitudinal distance between said spaced holes of said uprights.

9. The shelving system of claim 1, wherein said longitudinal flanges of said uprights have a depth greater than the amount which said corner pieces project outwardly from the exterior surfaces of said shelves such that spaces are left between said uprights and said corner pieces that are able to take up resilient flexing during assembly.

10. The shelving system of claim 1, wherein said protrusion comprises at least one T-shaped tab extending outwardly from said corner piece, said at least one tab being engageable in one of said holes of said uprights.

11. The shelving system of claim 10, wherein a plurality of said tabs are on each said corner piece disposed in two rows extending in the longitudinal direction of said upright, each row comprising at least one tab.

* * * * *